US007841971B2

(12) United States Patent
Smith

(10) Patent No.: US 7,841,971 B2
(45) Date of Patent: Nov. 30, 2010

(54) GOLF EXERCISE MACHINE

(76) Inventor: Murray W. Smith, Box 848. Alberta, Beaverlodge (CA) T0H 0C0

( * ) Notice: Subject to any disclaimer, the term of this patent is extended or adjusted under 35 U.S.C. 154(b) by 0 days.

(21) Appl. No.: 12/270,036

(22) Filed: Nov. 13, 2008

(65) Prior Publication Data

US 2009/0131231 A1 May 21, 2009

Related U.S. Application Data

(60) Provisional application No. 60/988,628, filed on Nov. 16, 2007.

(51) Int. Cl.
*A63B 21/062* (2006.01)

(52) U.S. Cl. ..... 482/103; 482/139; 473/229

(58) Field of Classification Search ..... 482/92–94, 482/98–103, 110–111, 122–123, 133, 135–136, 482/138–139, 148; 473/219, 226, 229, 276
See application file for complete search history.

(56) References Cited

U.S. PATENT DOCUMENTS

| | | | | | |
|---|---|---|---|---|---|
| 3,438,627 | A * | 4/1969 | Lanne | 482/103 |
| 4,407,495 | A * | 10/1983 | Wilson | 482/97 |
| 4,549,733 | A * | 10/1985 | Salyer | 482/103 |
| 4,609,189 | A * | 9/1986 | Brasher | 482/102 |
| 4,988,095 | A | 1/1991 | Ferrari | |
| 5,042,798 | A * | 8/1991 | Sawicky | 482/129 |
| 5,064,191 | A * | 11/1991 | Johnson | 482/143 |
| 5,125,882 | A * | 6/1992 | La Mothe et al. | 482/114 |
| 5,156,402 | A | 10/1992 | Hart | |
| 5,242,344 | A * | 9/1993 | Hundley | 482/93 |
| 5,842,961 | A * | 12/1998 | Davis | 482/139 |
| 6,579,214 | B2 | 6/2003 | Crump | |
| 7,121,987 | B2 | 10/2006 | Sharps | |
| 7,625,321 | B2 * | 12/2009 | Simonson et al. | 482/103 |
| 7,641,595 | B2 * | 1/2010 | Sharps | 482/51 |
| 7,641,596 | B2 * | 1/2010 | Sharps | 482/51 |
| 2002/0111251 | A1 * | 8/2002 | Crump | 482/99 |
| 2006/0019804 | A1 * | 1/2006 | Young | 482/93 |

* cited by examiner

*Primary Examiner*—Loan Thanh
*Assistant Examiner*—Daniel F Roland
(74) *Attorney, Agent, or Firm*—The Webb Law Firm

(57) ABSTRACT

A golf exercising apparatus is provided. The apparatus can include a horizontal base member with platform, a vertical lower frame member attached to the base member and a vertical upper frame member pivotally attached to the lower frame member whereby the upper frame member can tilt side-to-side relative to the lower frame member to accommodate right-handed and left-handed golf swings. A pivoting pulley assembly can be supported at an elevated position by the upper frame member. A cable can be anchored at one end to the upper frame member or to the pulley assembly. The other end of the cable can pass through the pulley assembly and can have a handle attached thereon. The cable can be tensioned to provide resistance by suspending weights from the cable between its anchored end and the pulley assembly. The golf swing is exercised by pulling the handle in a golf swing-like motion. Increasing the weights suspended on the cable increases the resistance in the golf swing motion.

13 Claims, 14 Drawing Sheets

GOLF EXERCISE MACHINE

CROSS REFERENCE TO RELATED APPLICATION

This application claims priority to U.S. Provisional Patent Application No. 60/988,628, filed on Nov. 16, 2007, the contents of which are expressly incorporated herein by reference.

FIELD OF THE INVENTION

The present invention relates to exercise and training equipment, and more particularly to a golf exercising apparatus.

BACKGROUND OF THE INVENTION

Golf can be a physically demanding sport since it takes power and muscular control to hit a golf ball at high speeds consistently during a round of golf. There is a current trend towards using larger club heads, which has resulted in increased physical demands placed on the golfer's body. This may lead to injuries in the unconditioned golfer.

Unlike other sports, however, playing golf is generally perceived to not increase one's golf-specific fitness. Since a golf swing lasts only a few seconds, it is highly desirable to perform exercises to target and strengthen the specific muscles important in the golf swing in order to truly improve one's golfing. By exercising the muscles used in golf, one may be able to increase strength, flexibility, stamina, club head speed and driving distance while decreasing the risk of golf-induced injuries.

There is a number of golf exercising equipment that is known in the art. For example, U.S. Pat. No. 5,242,344, which discloses a golf exercise device comprising a cable having one end connected to a weight stack and the other end connected to a cam wheel structure. A pivotal swing arm is connected to a cam rail to rotate a cam wheel upon pivotal motion of the swing arm. A linkage apparatus is provided for transferring a golf club stroke into a swinging motion of the swing arm to pull the cable to rotate the cam wheel and lift the selected weights on the weight stack.

The above described prior art is a representative example of known exercise and training device incorporating a cable connected to weights and a mechanism for transferring the golf swing motion to lifting of weights. A major deficiency of prior arts of this kind is the complexity in design and cost to manufacture.

It is, therefore, desirable to provide a simple and cost-effective golf exercising machine.

SUMMARY OF THE INVENTION

An exercising apparatus for training and strengthening the golf swing is provided. In one embodiment, the apparatus can comprise a frame for providing a supporting structure for the components including a pulley assembly and means for applying resistance. In one embodiment, the frame can comprise a base frame member with a platform for a person to stand on, a lower frame member portion attached to the base frame member and an upper frame member for supporting the pulley assembly at an elevated position. In another embodiment, the upper frame member can be pivotally coupled to the lower frame portion to allow side-to-side tilting of the upper frame member relative to the lower frame member to allow the apparatus to be used to exercise both right-handed and left-handed golf swings.

In one embodiment, the pulley assembly can be pivotally attached to the upper frame member. At least one pulley is rotatably mounted on the pulley assembly for guiding a cable. A first end of the cable is operatively attached to an anchor. In one embodiment, the anchor can be operatively attached to the upper frame member. In another embodiment, the anchor can be operatively attached to the pulley assembly. A second end of the cable passes through the pulley assembly to rotatably engage the at least one pulley. A handle is operatively attached to the second end that can be grasped by a user.

In one embodiment, resistance means for imparting tension on the cable is operatively coupled to the cable between the first or anchored end and the pulley assembly. A user pulling the handle in a golf swing-like motion must apply a force equal to or greater than the tension in the cable in order to pull the cable through the pulley assembly. The resistance means can include free weights, springs, resistance bands, resistance rods, hydraulic cylinders, combinations thereof or any other suitable resistance means as well known to those skilled in the art.

In another embodiment, the upper frame member can be raised or lowered to raise or lower the pulley assembly to predetermined elevated position. This allows the apparatus to be adjusted in height to accommodate the particular preference of the user.

BRIEF DESCRIPTION OF THE DRAWINGS

Throughout the drawings and specification, like reference characters are used consistently to denote like parts unless otherwise indicated to the contrary.

DETAILED DESCRIPTION OF THE INVENTION

Figure 1:
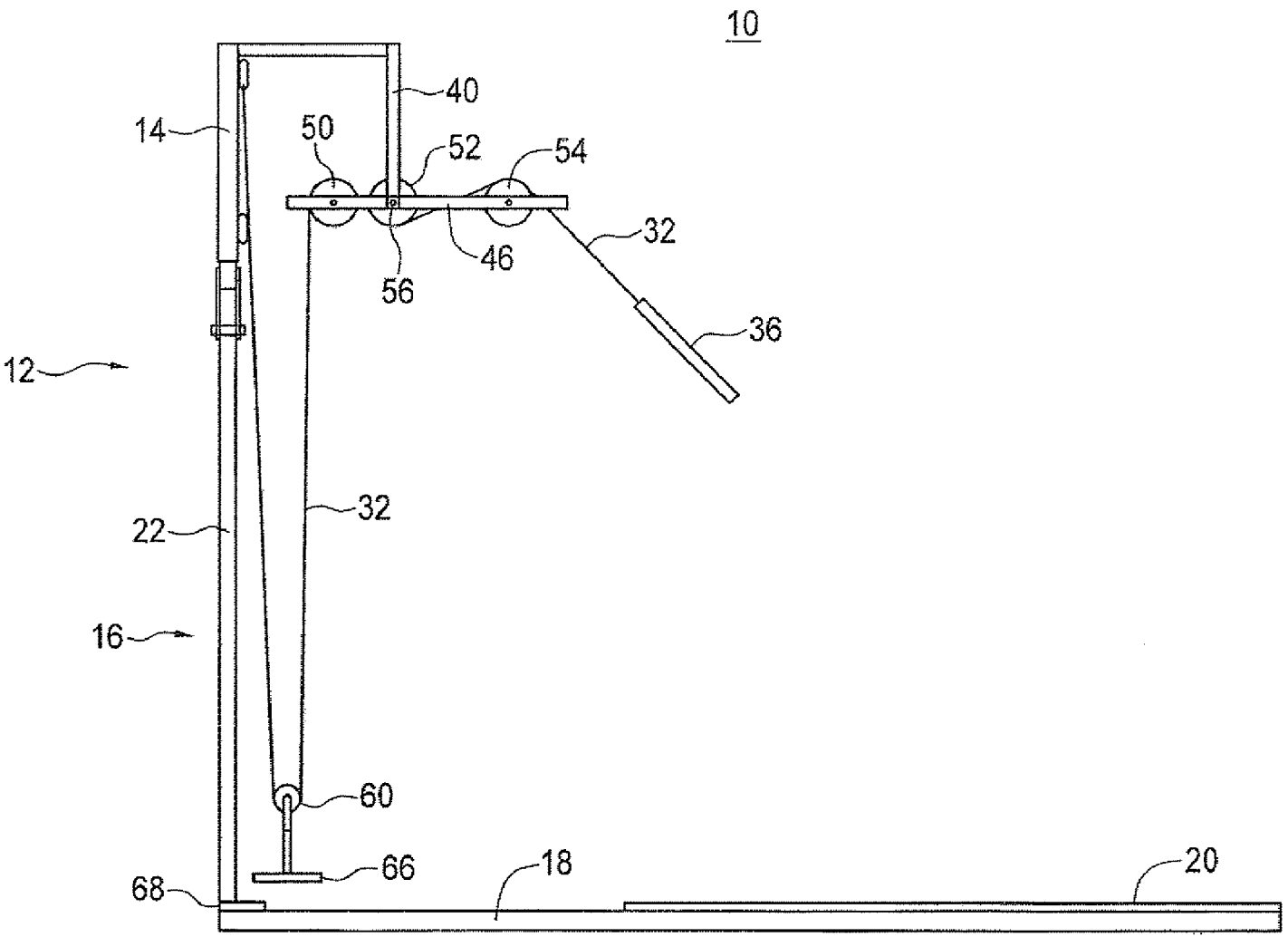
FIG. 1 is a side elevational view depicting one embodiment of a golf exercise apparatus according to the present invention.

Referring to FIGS. 1 through 4, a first embodiment of golf exercise apparatus 10 is illustrated. Apparatus 10 can comprise of frame 12 that, in turn, can comprise base frame member 18, lower frame member 16 and upper frame member 14. Frame members 14, 16, 18 can be made of tubing made of metal such as steel, aluminium metal alloys or any other material suitable for frame construction as known to those skilled in the art. The tubing can be square, rectangular, circular, oval or of any suitable cross-section profile and of a dimension and have a sidewall thickness suitable for providing a sturdy structure as can be easily determined by those skilled in the art. The sections of tubing used to form apparatus 10 can be welded together or can be joined together using any suitable fasteners or combinations thereof as well known to those skilled in the art.

In another embodiment, base member 18 can be a rectangular frame structure having platform 20 fastened thereupon. In other embodiments, base member 18 can also be triangular, circular, oval or polygonal in configuration and can be further constructed to provide a supportive base for apparatus 10 that resists apparatus 10 from tipping over. Lower frame member 16 can be attached to base member 18 with hinge 68. This allows upper and lower frame members 14 and 16 to be folded down towards base member 18 to store apparatus 10 when not in use.

Figure 2:
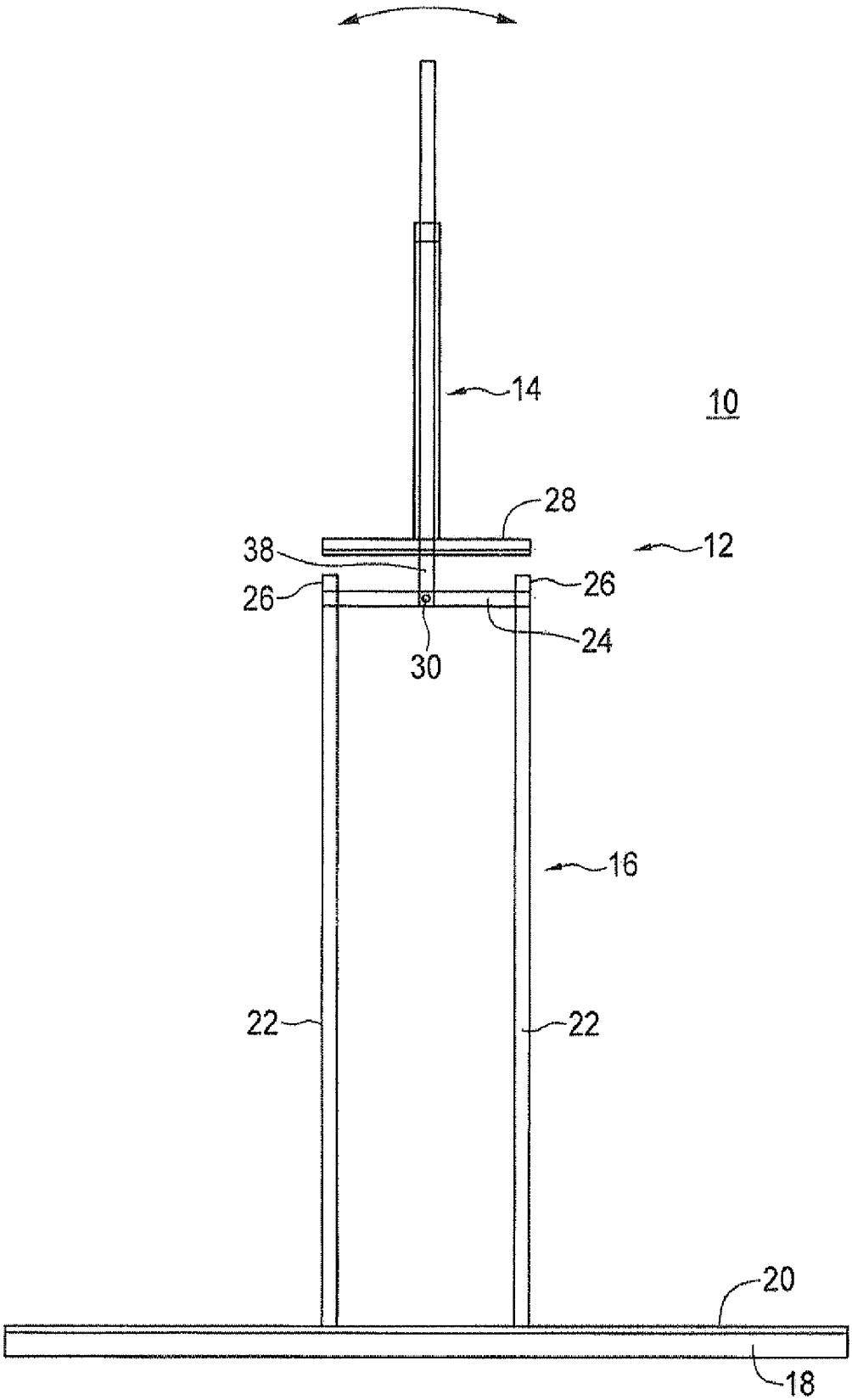
FIG. 2 is a rear elevational view depicting the golf exercise apparatus of FIG. 1.
Figure 3:
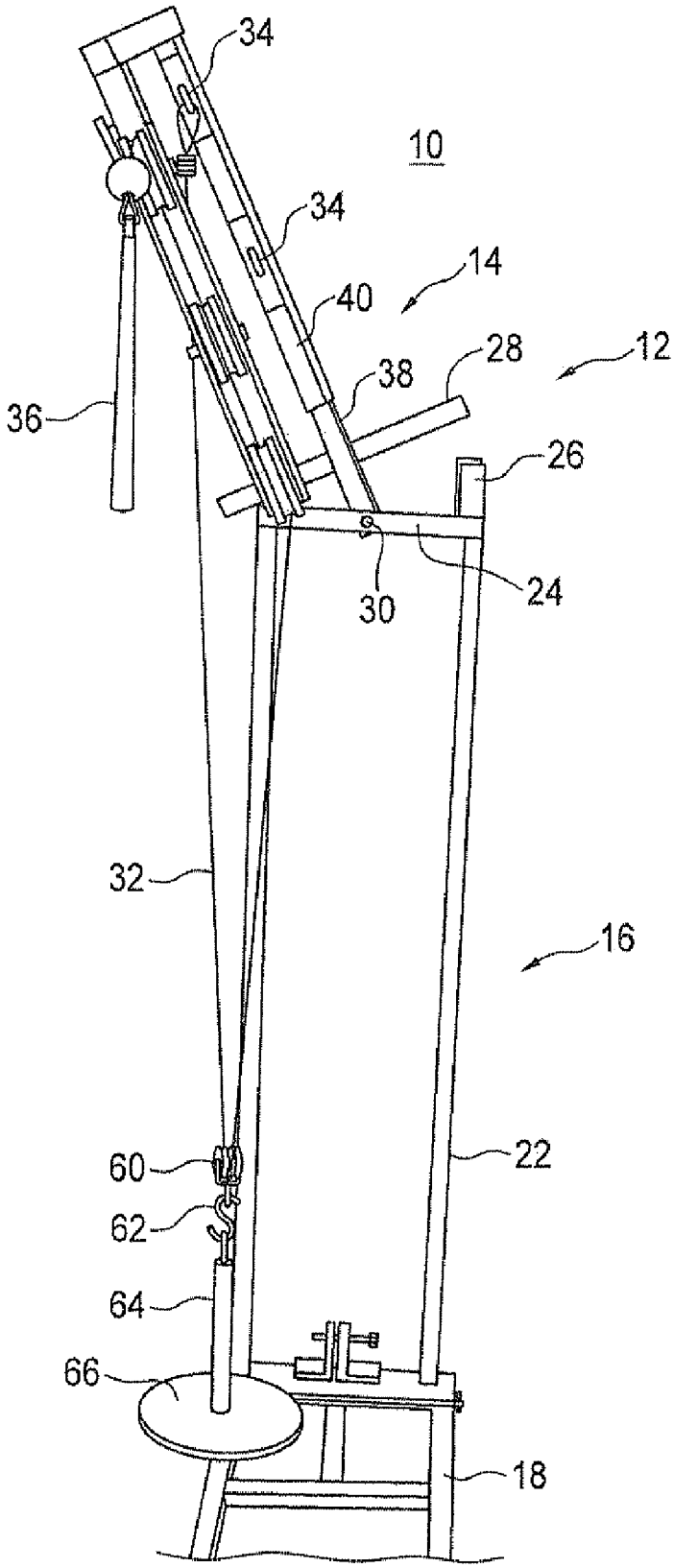
FIG. 3 is a front elevational view depicting the golf exercise apparatus of FIG. 1 with the upper frame member tilted to accommodate a left-handed golf swing.

Referring to FIGS. 2 and 3, lower frame member 16 can be comprised of vertical leg members 22 attached to one another with cross member 24. Upper frame member 14 can be pivotally attached to lower frame member 16 at pivot point 30 on cross member 24. Upper frame member 14 can have horizontal cross member 28 which engages u-shaped catches 26 disposed on top of each of legs 22. Catch 26 receives cross member 28 as upper frame member 14 is tilted left to right about pivot point 30. The width of cross members 24 and 28 and the position of cross member 28 on vertical member 38 can all contribute to the angle of upper frame 14 with respect to lower frame member 16. In one embodiment, cross member 28 is configured whereby upper frame member 14 can be tilted approximately 30° from vertical to provided a comfortable position for a user using apparatus 10. The degree of how much upper frame member 14 can tilt can be changed by adjusting the length of cross member 28 and/or by adjusting cross member 28's position on vertical member 38. It should be obvious that any suitable means can be used to adjust the tilt angle of upper frame member 14 as known to those skilled in the art.

In one embodiment, upper frame member 14 can comprise inverted u-shaped sliding frame member 40 attached thereon. Vertical member 38 can comprise a plurality of holes disclosed along its length for receiving a stop pin (not shown). Sliding frame member 40 can be raised or lowered on vertical member 38 to set the desired height of apparatus 10 and prevent sliding frame member 40 from sliding downwards. It should be obvious to those skilled in the art that any other suitable means can be used to secure sliding frame member 40 to vertical member 38.

In a further embodiment, pulley assembly 46 can be rotatably attached to sliding frame member 40 at pivot point 56. In another embodiment, pulley assembly 46 can include at least one pulley rotatably attached thereon. In the illustrated embodiment, pulley 46 can have three pulleys as shown by pulleys 50, 52 and 54. The rotational axis of each of pulleys 50, 52 and 54 are all substantially parallel to one another. In a further embodiment, the rotational axis of pulley 52 can coincide with pivot point 56. In yet another embodiment, one end of cable 32 can be anchored to anchor 34 disposed on sliding frame member 40 of upper frame member 14. Cable 32 can be a rope, a chain, a cord, a stranded and braided wire cable or any other suitable cable means known to those skilled in the art.

Figure 4:
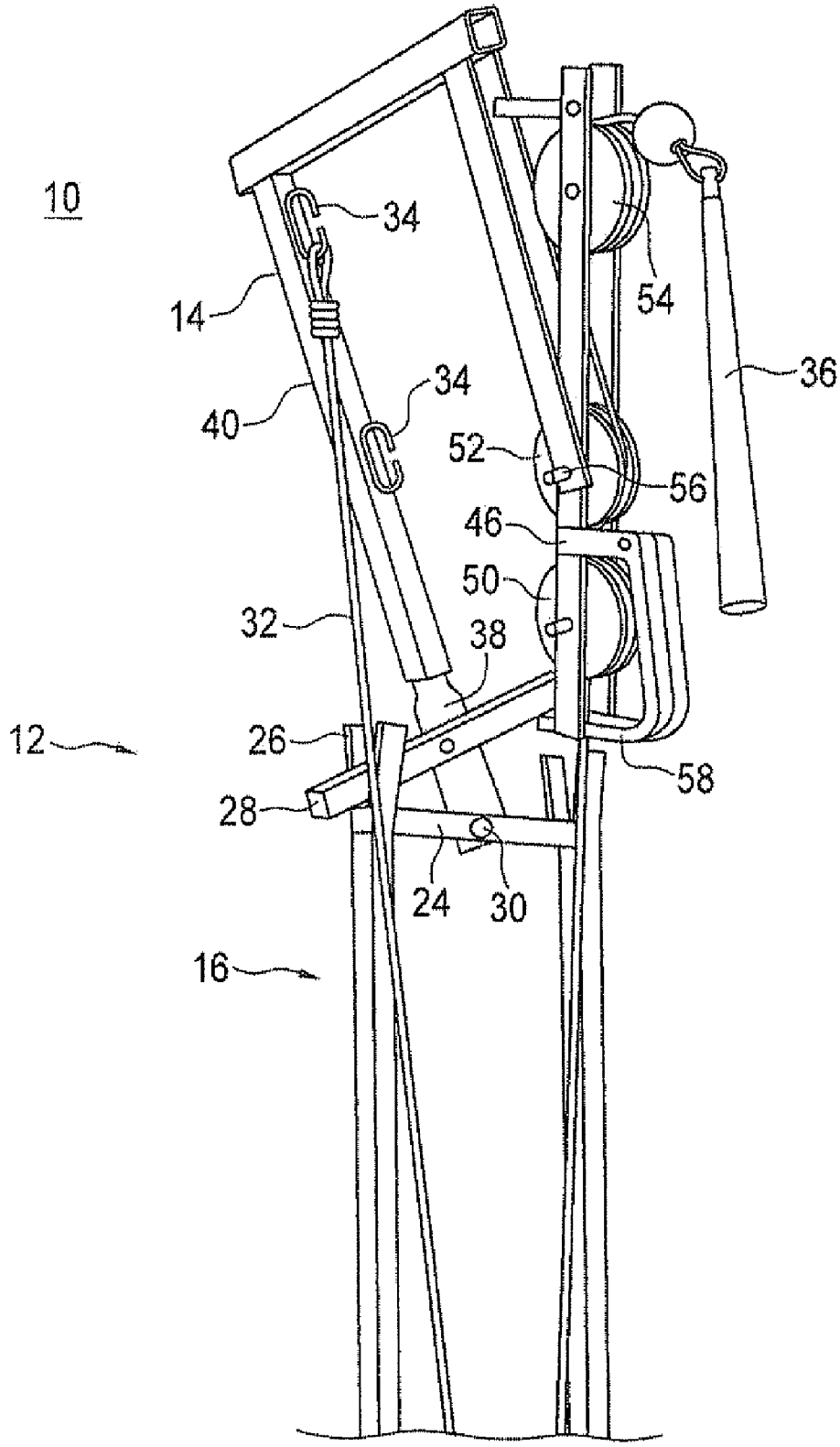
FIG. 4 is a left perspective view depicting the golf exercise apparatus of FIG. 1 with the upper frame member tilted to accommodate a left-handed golf swing.

In the illustrated embodiment in FIG. 4, sliding frame member 40 can include more than one anchor 34. This is to allow adjustment to the anchor point of cable 32 when sliding frame member 40 is raised or lowered on vertical member 38. The second end of cable 32 is fed through pulley block 60 before it is fed through pulley assembly 46. In the illustrated embodiments, cable 32 engages the tops of pulleys 50 and 54 and the bottom of pulley 52. The second end of cable 32 terminates in handle 36. In the illustrated embodiment, handle 36 can be a portion of a golf shaft having a golf grip. Attached to pulley block 60 can be hook 62 which is releasably attached to weight holder 64. Weight holder 64 provides support for free weight plate 66. In a further embodiment, pulley assembly 46 can further comprise cable guides 58 which guide cable 32 onto pulley 50 as apparatus 10 is being used, which will be described in greater detail below.

Figure 5:
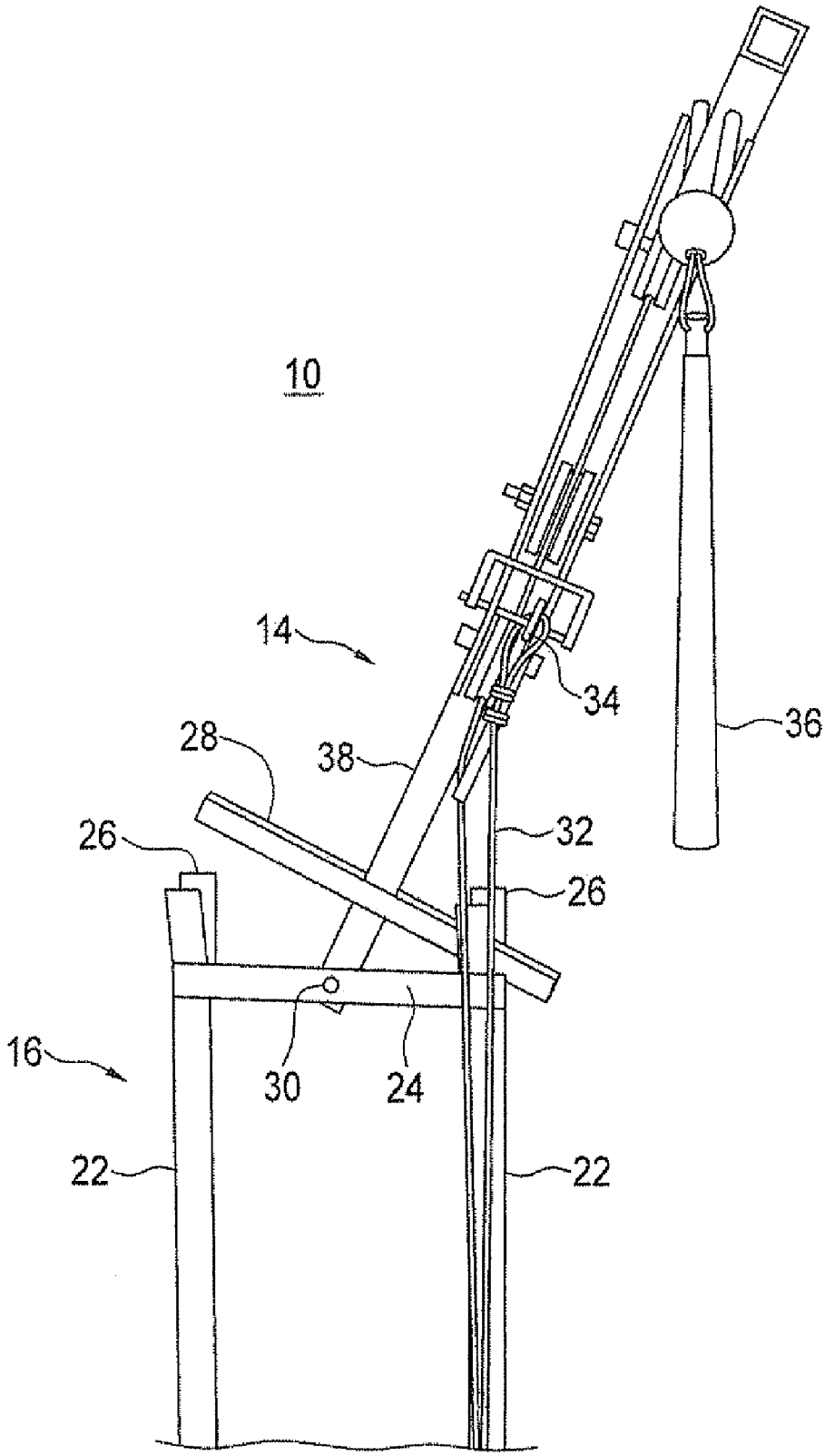
FIG. 5 is a front elevational view depicting a second embodiment of a golf exercise apparatus with the upper frame member tilted to accommodate a right-handed golf swing.
Figure 6:
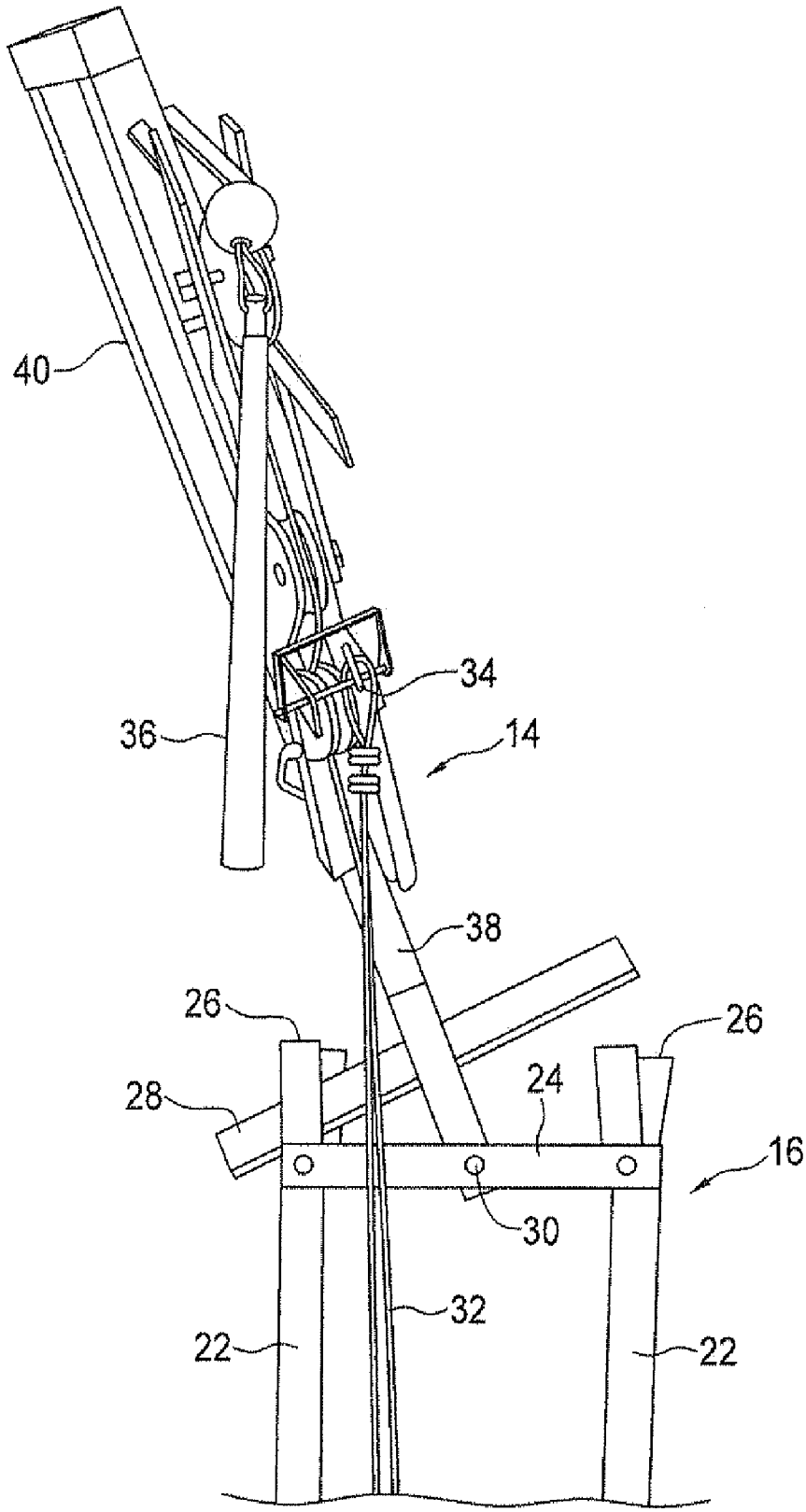
FIG. 6 is a front elevational view depicting the golf exercise apparatus of FIG. 5 with the upper frame member tilted to accommodate a left-handed golf swing.
Figure 7:
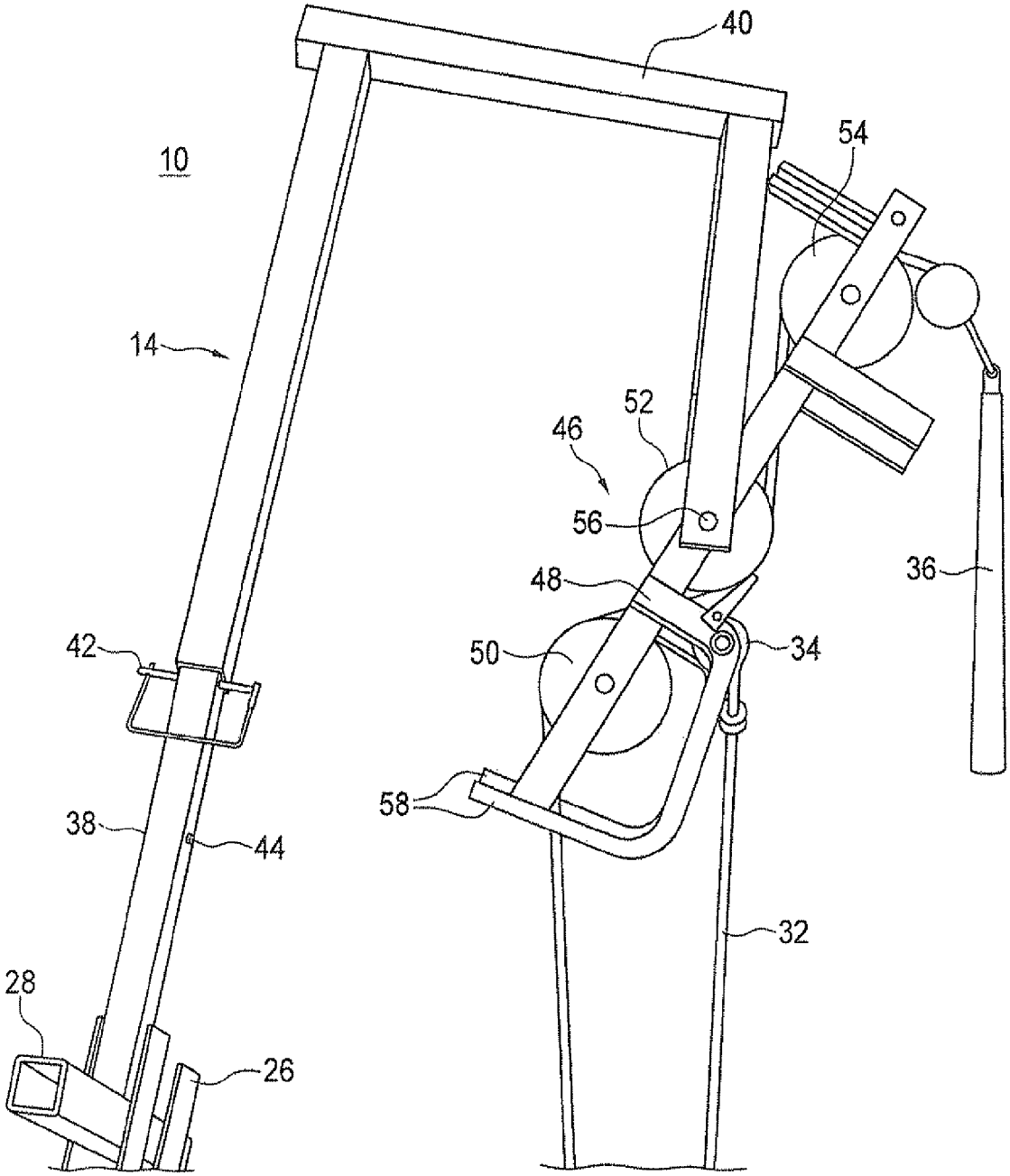
FIG. 7 is a side elevational view depicting the upper frame member of the golf exercise apparatus of FIG. 5.

Referring to FIGS. 5 though 7, a second embodiment of apparatus 10 is illustrated. In this embodiment, one end of cable 32 is anchored to anchor 34 disposed on pulley assembly 46 at strap member 48. Referring specifically to FIG. 7, sliding frame member 40 is shown in an elevated position with respect to vertical member 38. A plurality of holes 44 can be disposed along vertical member 38 to receive adjustment pin 42. As illustrated, pin 42 can be placed in a desired hole 44 to provide a vertical stop for sliding frame member 40 thereby supporting pulley assembly 46 at a predetermined height.

It should be obvious to those skilled in the art that the embodiments of apparatus 10 described above are configurations chose for convenience and not for necessity, it being understood that sliding frame member 40 does not have to an inverted, u-shaped member. It is contemplated that other embodiments of apparatus can have a pedestal configuration whereby base member 18 and lower frame member 16 can form the base of the pedestal. In further embodiments, upper frame member 14 can be tiltably attached to lower frame member 16 and can support pulley assembly 40 from underneath instead of from above. In yet further embodiments, either or both of upper and lower frame members 14 and 16 can telescoped in length to set pulley assembly 40 at a desired height for a user.

Figure 8:
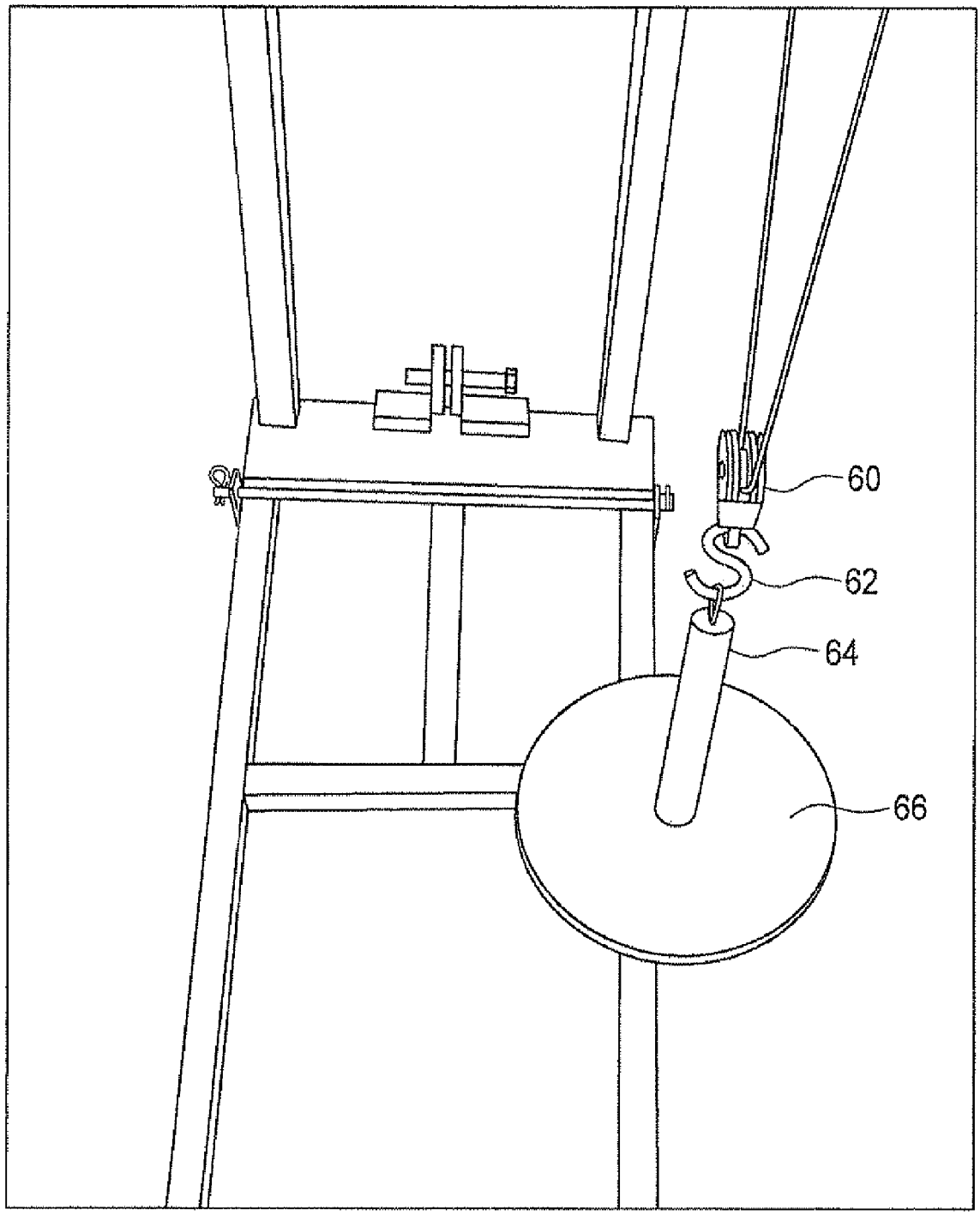
FIG. 8 is a perspective view depicting a free weight stack for use with the golf exercise apparatus of FIG. 1 or FIG. 5.
Figure 9:
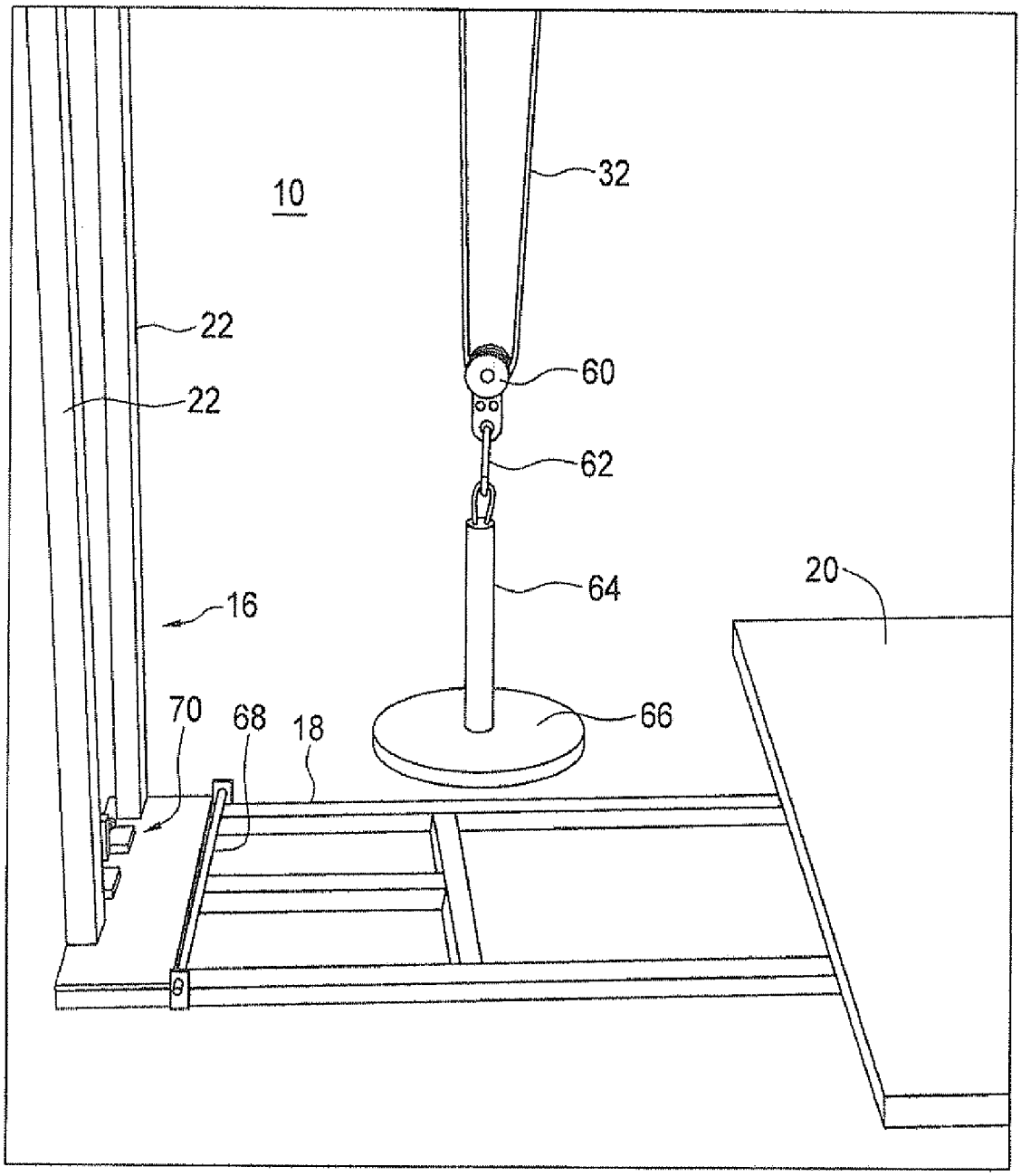
FIG. 9 is a side elevational view depicting the free weight stack of FIG. 8.

Referring to FIGS. 8 and 9, an embodiment of apparatus 10 is shown to highlight the lower frame members. Lower frame member 16 can be rotatably attached to base frame member 18 at hinge 68. Lower frame member 16 can be locked into a substantial vertical position with respect to base frame member 18 using locking pin 70. As shown in FIGS. 8 and 9, cable 32 is fed through pulley block 60. In this embodiment, s-hook 62 can be attached to pulley block 60 which, in turn, can be attached to weight holder 64. In the illustrated embodiment, weight holder 64 can be configured to support one or more free weight plates 66. The addition or removal of weight plates 66 with respect to weight holder 64 determines the amount of resistance required to operate apparatus 10. In the illustrated embodiments, the use of free weights is provided as the resistance means for apparatus 10. It should be obvious to those skilled in the art that weight holder 64 and weight plate 66 can be replaced by any other suitable means to provide resistance as cable 32 is pulled. These can include, but are not limited to, the use of springs attached to base member 18 and hook 62, use of springs, resistance bands, resistance rods, torsion bars, hydraulic cylinders, any combination thereof or any other suitable resistance means as known to those skilled in the art.

Figure 10:
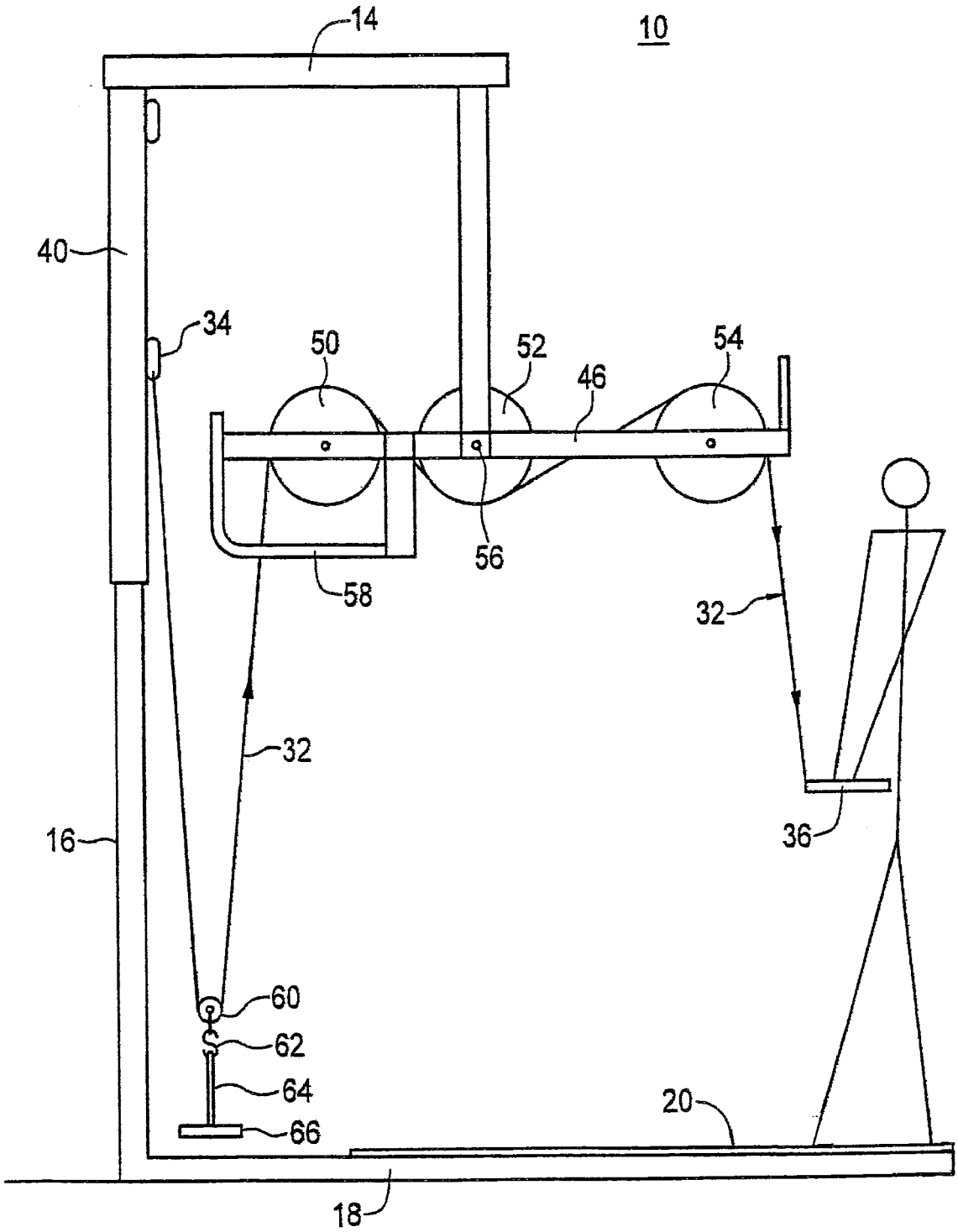
FIG. 10 is a side elevational view depicting a schematic of the golf exercise apparatus of FIG. 1 at the approximate beginning of a right-handed golf swing.
Figure 11:
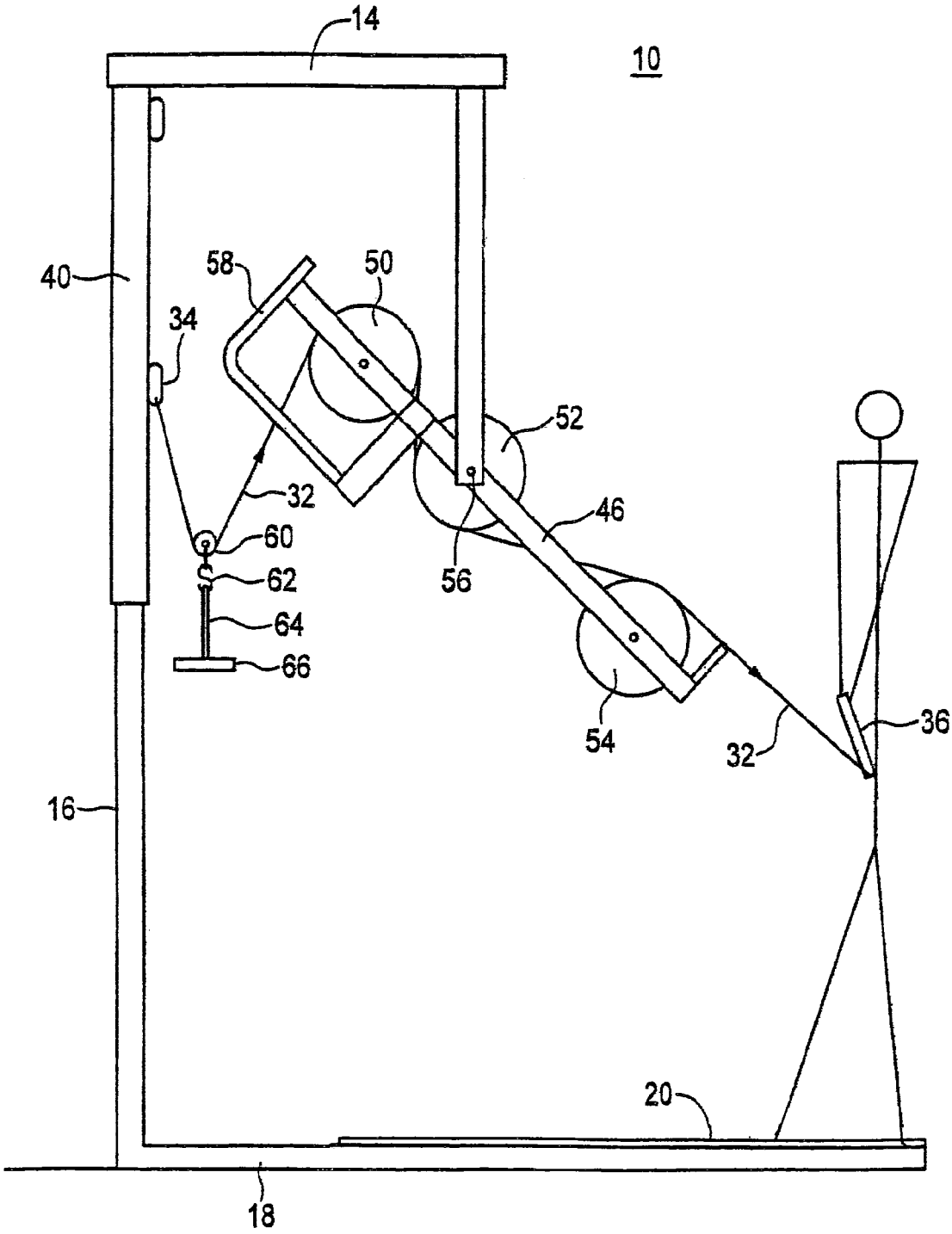
FIG. 11 is a side elevational view depicting a schematic of the golf exercise apparatus of FIG. 1 at the approximate middle of a right-handed golf swing.
Figure 12:
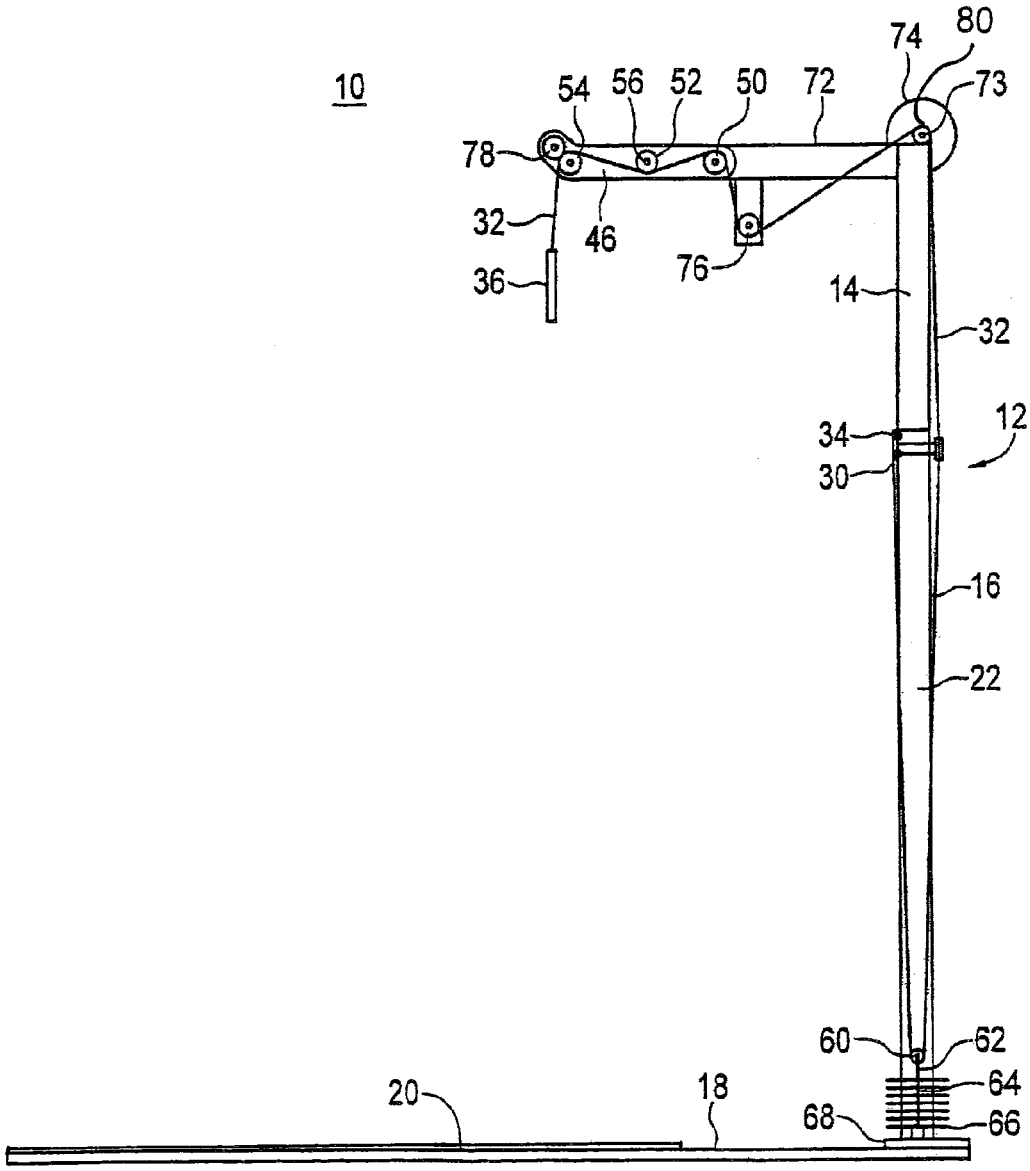
FIG. 12 is a side elevational view depicting a third embodiment of a golf exercise apparatus.

Referring to FIG. 10, apparatus 10 is shown when a person begins pulling handle 36 to emulate a golf swing. When a user pulls handle 36, cable 32 is drawn from pulley assembly 46 which has the effect of bringing pulley apparatus 46 to an approximate horizontal orientation. Cable 32 also begins to pull up and raise pulley block 60. In this configuration, the anchoring of cable 32 at anchor 34 has the effect of acting like a simple block and tackle device. In this configuration, the tension in cable 32 is approximately half of the downward force exerted on cable 32 by free weight plate 66. Referring to FIG. 11, apparatus 10 is shown when a user has pulled handle 36 to the approximate middle of a golf swing. In this position, pulley apparatus 46 has been tilted downwardly towards the user.

In another embodiment, pulley 54 is placed further away from pivot point 56 than pulley 50 on pulley assembly 46. This configuration has the effect of pulley assembly 46 acting like a simple lever when handle 32 is first drawn from pulley assembly 46 by a user. This can reduce the amount of force to initially draw cable 32 through pulley assembly 46 as shown in FIG. 10. As a user continues with the golf swing, the force required to pull cable 32 will increase as pulley assembly 46 begins tilting downwardly as shown in FIG. 11. Accordingly, this arrangement allows user to start the movement with a lesser force and having increasing resistance as user begins pulling cable 32 from pulley assembly 46.

Figure 13:
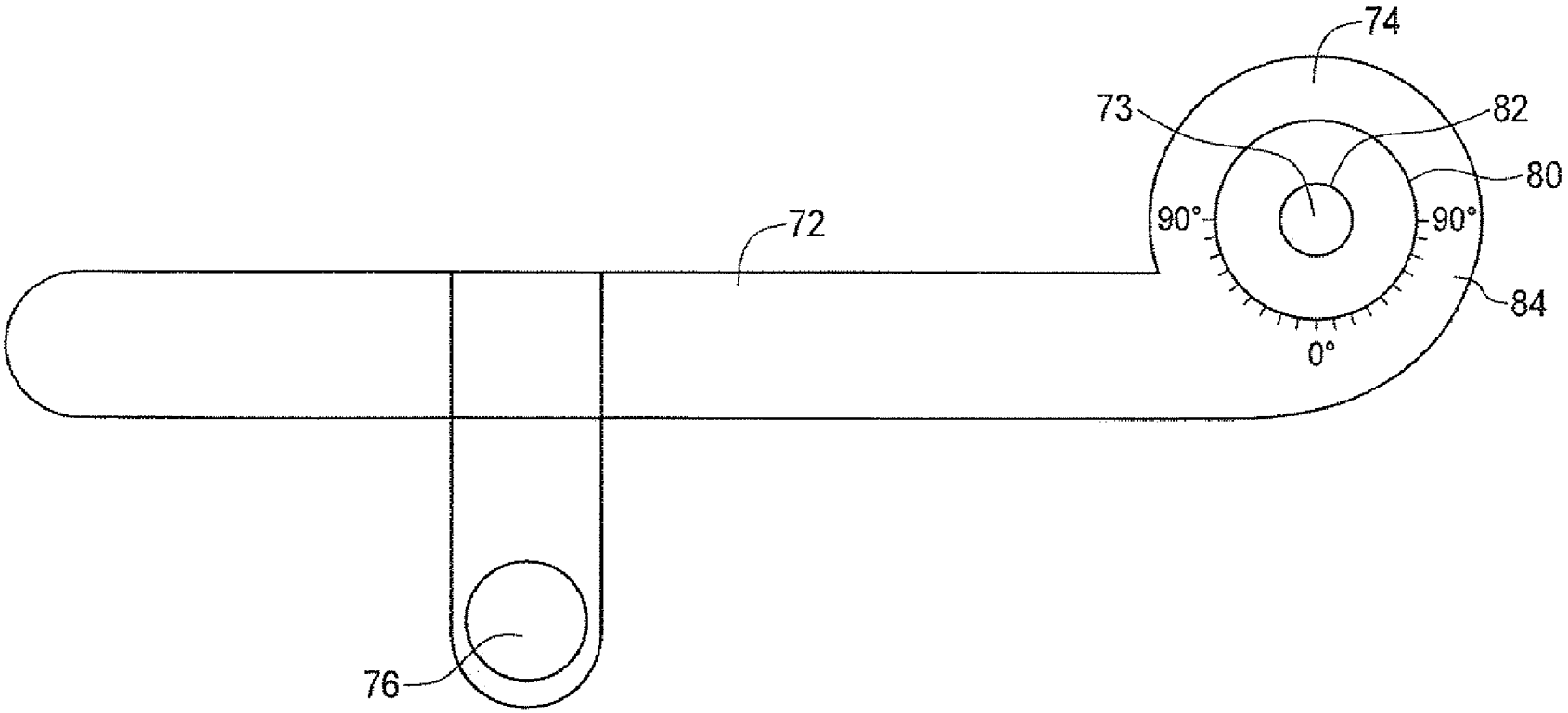
FIG. 13 is a side elevational view depicting a close up view of the height adjustment member in the golf exercise apparatus of FIG. 12.

Referring to FIGS. 12, 13, 14A, and 14B, a further embodiment of apparatus 10 is illustrated. Apparatus 10 can include a height adjustment member 72 that can be rotatably attached to upper frame member 14 at pivot point 73 and can include a height adjustment wheel 74. Referring specifically to FIG. 13, in one embodiment, the height adjustment member 72 can include pulleys 76 and 80, as well as an adjustable bolting mechanism 82 used to rotatably attach height adjustment member 72 to upper frame member 14 at pivot point 73. Bolting mechanism 82 can be loosened to raise or lower height adjustment member 72 and can be tightened to fix height adjustment member 72 at a desired height. Height adjustment member 72 can also include a series of graduations 84 used to determine the angle of adjustment to which height adjustment member 72 is either raised or lowered.

Figure 14A:
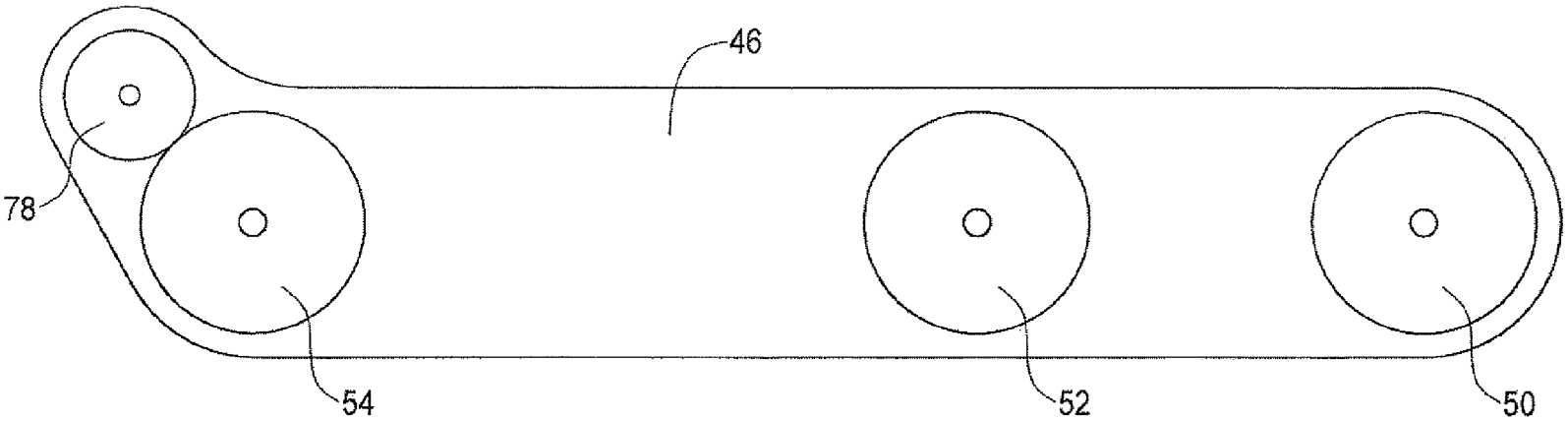
FIG. 14A is a side elevational view depicting a close up view of the pulley assembly in the golf exercise apparatus of FIG. 12.
Figure 14B:
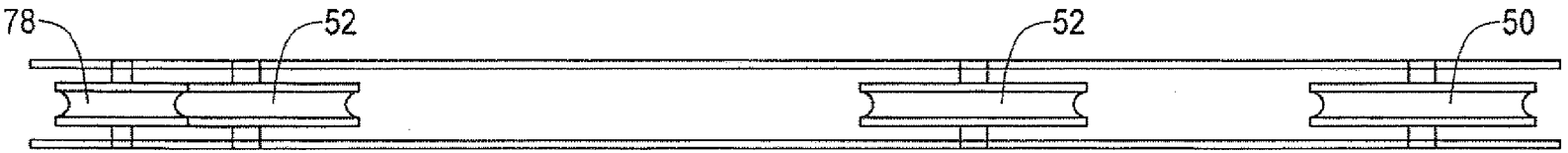
FIG. 14B is a top plan view depicting a close up view of the pulley assembly in the golf exercise apparatus of FIG. 12.

In one embodiment, pulley assembly 46 can be rotatably attached to height adjustment member 72 at pivot point 56. In the illustrated embodiment, pulley assembly 46 can have three pulleys as shown by pulleys 50, 52 and 54. Pulleys 50, 52 and 54 can be unequally spaced-apart on pulley assembly 46, as shown in FIGS. 14A and 14B. The rotational axis of pulley 52 can coincide with pivot point 56.

In yet another embodiment, one end of cable 32 can be anchored to anchor 34 disposed on upper frame member 14. Upper frame member 14 can include more than one anchor 34. This is to allow adjustment to the anchor point of cable 32 when height adjustment member 72 is raised or lowered with respect to upper frame member 14. The second end of cable 32 is fed through pulley block 60 before it is fed through pulleys 80 and 76, then pulley assembly 46. In one embodiment, pulley 78 can act as a cable guide to prevent cable 32 from being derailed from pulley 54. In the illustrated embodiment, cable 32 engages the tops of pulleys 80, 50 and 54 and the bottom of pulleys 76, 52 and 78. The second end of cable 32 terminates in handle 36.

When a user pulls handle 36, cable 32 is drawn from pulley assembly 46 which has the effect of tilting pulley apparatus 46 downwardly towards the user. Cable 32 also begins to pull up and raise pulley block 60 that, in turn, pulls up weight holder 64 and weight plates 66 via hook 62. This configuration has the effect of pulley assembly 46 acting like a simple lever when handle 32 is first drawn from pulley assembly 46 by a user. In this configuration, the anchoring of cable 32 at anchor 34 has the effect of acting like a simple block and tackle device.

Although a few preferred embodiments have been shown and described, it will be appreciated by those skilled in the art that various changes and modifications might be made without departing from the scope of the invention. The terms and expressions used in the preceding specification have been used herein as terms of description and not of limitation, and there is no intention in the use of such terms and expressions of excluding equivalents of the features shown and described or portions thereof, it being recognized that the scope of the invention is defined and limited only by the claims that follow.

I claim:

1. An apparatus, comprising:

a) a support member configured for supporting a pulley assembly pivotally attached to the support member at an elevated position, the pulley assembly comprising at least one pulley rotatably attached thereto, the support member further comprising:

i) a substantially horizontal base frame member having a longitudinal axis, ii) a platform disposed on top of the base frame member, iii) a substantially vertical lower frame member operatively attached to the base frame member, and iv) a substantially vertical upper frame member disposed on the top of the lower frame member, the upper frame member supporting the pulley assembly at the elevated position, wherein the upper frame member is pivotally attached to the lower frame member whereby the upper frame member can be tilted to a left or a right position with respect to the lower and base frame members, the pivot axis of the pivotal attachment substantially parallel to the longitudinal axis of the base frame member;

b) a cable having a first end operatively attached to an anchor disposed on the apparatus and a second end that passes through the pulley assembly and engages the at least one pulley, the second end having a handle operatively attached thereto; and c) a resistance member operatively coupled to the cable between the first end and the pulley assembly wherein tension is imparted on the cable when the handle is pulled away from the pulley assembly thereby drawing the cable through the pulley assembly.

2. The apparatus as set forth in claim 1, wherein the lower frame member is pivotally attached to the base frame member whereby the lower frame member can pivot from a substantially vertical position towards the base frame member to a substantially horizontal position adjacent to the base frame member.

3. The apparatus as set forth in claim 1, wherein the upper frame member further comprises a sliding frame member secured to the support member that can be raised or lowered on the support member for raising or lower the pulley assembly to a predetermined elevated position.

4. The apparatus as set forth in claim 1 wherein the pulley assembly is pivotally attached to a height adjustment member pivotally attached to the upper frame member whereby the pulley assembly can be raised or lowered with respect to the lower and base frame members by rotating the height adjustment member with respect to the upper frame member.

5. The apparatus as set forth in claim 1, wherein the upper frame member further comprises an inverted U-shaped member whereby the pulley assembly is pivotally attached to one leg of the inverted U-shaped member.

6. The apparatus as set forth in claim 1, wherein the anchor is operatively attached to the support member or to the pulley assembly.

7. The apparatus as set forth in claim 1, wherein the anchor is operatively attached to the upper frame member.

8. The apparatus as set forth in claim 1, wherein the pulley assembly comprises at least three pulleys rotatably attached thereto, the rotational axes of the pulleys substantially parallel to one another and spaced apart in a substantially linear manner whereby the cable is wound over the tops of the first and last of the at least three pulleys and wound under the bottom of a middle pulley.

9. The apparatus as set forth in claim 8, wherein the rotational axis of the middle pulley coincides with the rotation axis of the pulley assembly.

10. The apparatus as set forth in claim 8, wherein the at least three pulleys are unequally spaced-apart along the pulley assembly.

11. The apparatus as set forth in claim 10, wherein the at least three pulleys are spaced-apart along the pulley assembly so that the initial force required to pull the cable is less than the force required to continue pulling the cable.

12. The apparatus as set forth in claim 1, further comprising a pulley block disposed on the cable, the pulley block being operatively coupling to the resistance member.

13. The apparatus as set forth in claim 12, wherein the resistance member comprises one or more selected from the group consisting of free weights, springs, resistance bands, resistance rods, and hydraulic cylinders.

* * * * *

UNITED STATES PATENT AND TRADEMARK OFFICE

CERTIFICATE OF CORRECTION

PATENT NO. : 7,841,971 B2
APPLICATION NO. : 12/270036
DATED : November 30, 2010
INVENTOR(S) : Smith It is certified that error appears in the above-identified patent and that said Letters Patent is hereby corrected as shown below:

Column 6, Line 62, Claim 3, "for raising or lower" should read -- for raising or lowering --

Column 8, Line 13, Claim 12, "being operatively coupling" should read
-- being operatively coupled --

Signed and Sealed this
Twelfth Day of April, 2011

David J. Kappos

David J. Kappos
*Director of the United States Patent and Trademark Office*